US008043019B2

(12) United States Patent
Walker et al.

(10) Patent No.: US 8,043,019 B2
(45) Date of Patent: Oct. 25, 2011

(54) CARD SUPPLYING AND STORAGE SYSTEM

(75) Inventors: Dana M. Walker, Dayton, OH (US); Edward P. Busam, Mason, OH (US)

(73) Assignee: MeadWestvaco Corporation, Richmond, VA (US)

( * ) Notice: Subject to any disclaimer, the term of this patent is extended or adjusted under 35 U.S.C. 154(b) by 0 days.

(21) Appl. No.: 10/803,748

(22) Filed: Mar. 17, 2004

(65) Prior Publication Data

US 2005/0207828 A1 Sep. 22, 2005

(51) Int. Cl.
*B42F 13/00* (2006.01)

(52) U.S. Cl. ..... 402/79

(58) Field of Classification Search ..... 402/73, 402/79, 80 R, 80 P; 281/38; 229/67.1, 67.4; 283/36–41

See application file for complete search history.

(56) References Cited

U.S. PATENT DOCUMENTS

| | | | | | |
|---|---|---|---|---|---|
| 2,333,798 | A | * | 11/1943 | Kner | 229/67.3 |
| 3,338,500 | A | * | 8/1967 | Bushey | 206/815 |
| 3,720,304 | A | * | 3/1973 | Laugherty et al. | 118/31.5 |
| 3,759,305 | A | * | 9/1973 | McIntyre | 150/149 |
| 3,930,700 | A | * | 1/1976 | Figueres | 312/183 |
| 3,970,397 | A | * | 7/1976 | Armstrong | 402/79 |
| 4,345,394 | A | | 8/1982 | Sullivan | |
| 4,614,450 | A | * | 9/1986 | Neiman | 402/79 |
| 4,934,740 | A | * | 6/1990 | Drake | 462/17 |
| 5,080,223 | A | * | 1/1992 | Mitsuyama | 206/39.5 |
| 5,213,433 | A | * | 5/1993 | An | 402/14 |
| 5,275,438 | A | * | 1/1994 | Struhl | 281/31 |
| 5,316,404 | A | * | 5/1994 | Hensel | 402/79 |
| 5,439,101 | A | * | 8/1995 | Brink et al. | 206/45.24 |
| 5,501,540 | A | * | 3/1996 | Ho | 402/73 |
| 5,573,110 | A | * | 11/1996 | Nguyen | 206/39 |
| 5,588,527 | A | * | 12/1996 | Youngs | 206/308.1 |
| D387,976 | S | * | 12/1997 | Mori | D6/634 |
| 5,765,875 | A | * | 6/1998 | Rowley | 283/74 |
| 5,966,852 | A | * | 10/1999 | Drzewiecki | 40/360 |
| 5,971,157 | A | * | 10/1999 | Howell et al. | 206/755 |
| 6,116,650 | A | * | 9/2000 | Nijboer et al. | 281/16 |
| 6,564,973 | B1 | * | 5/2003 | Brown et al. | 222/145.1 |
| 6,652,178 | B2 | * | 11/2003 | Walton | 402/79 |
| 6,776,437 | B1 | * | 8/2004 | Ho | 283/38 |
| 2002/0100797 | A1 | * | 8/2002 | Hollingsworth et al. | 229/92.8 |
| 2004/0247375 | A1 | * | 12/2004 | Wehmeyer et al. | 402/79 |

* cited by examiner

*Primary Examiner* — Dana Ross
*Assistant Examiner* — Matthew G Katcoff
(74) *Attorney, Agent, or Firm* — MWV Intellectual Property Group

(57) ABSTRACT

A system for storing index cards, the system including at least one storage sheet having at least one pocket, at least one supply sheet having at least one index card formed therein and detachable therefrom. The system further includes a binding mechanism that binds the storage sheet and the supply sheet together.

15 Claims, 6 Drawing Sheets

CARD SUPPLYING AND STORAGE SYSTEM

BACKGROUND

This invention is directed to a card dispensing and storage system and, more particularly, to an index card dispensing and storage system.

Index cards are useful items typically used in the home, classroom or office environments for various note taking and display purposes. Index cards typically are generally flat and have a front and a back surface on which a user can write or post various indicia. The relatively small dimensions of index cards may make them a nuisance to carry and store and they may easily be misplaced or lost.

Accordingly, there is a need for index cards that may easily be stored, thereby minimizing the risk of loss. Further, there is a need for a method for storing index cards that allows a user to easily access the index cards while storing them in a readily accessible location.

SUMMARY

The present invention is a system for supplying and storing index cards in which the cards can be easily stored and accessed. In one embodiment, the system includes at least one storage sheet having at least one pocket, at least one supply sheet having at least one index card formed therein and detachable therefrom, and a binding mechanism that binds the storage sheet and the supply sheet together.

In another embodiment the present invention is a method for assembling an index card storage system including the steps of providing at least one storage sheet having at least one pocket, providing at least one supply sheet that includes at least one index card formed therein and detachable therefrom, and binding the storage sheet and supply sheet together with a binding mechanism.

In yet another embodiment, the invention is a method for storing index cards including providing a system including at least one storage sheet having at least one pocket, at least one supply sheet having at least one index card formed therein and detachable therefrom, and a binding mechanism binding the at least one storage sheet and the at least one supply sheet together. The method further includes detaching the at least one index card from the supply sheet and storing the index card in the at least one pocket.

Other objects and advantages of the present invention will be apparent from the following description, the accompanying drawings and the appended claims.

BRIEF DESCRIPTION OF THE DRAWINGS

The invention can be understood with reference to the following drawings. In the drawings, like reference numerals designate corresponding parts throughout the several views. Also, the components in the drawings are not necessarily to scale.

DETAILED DESCRIPTION

Figure 1:
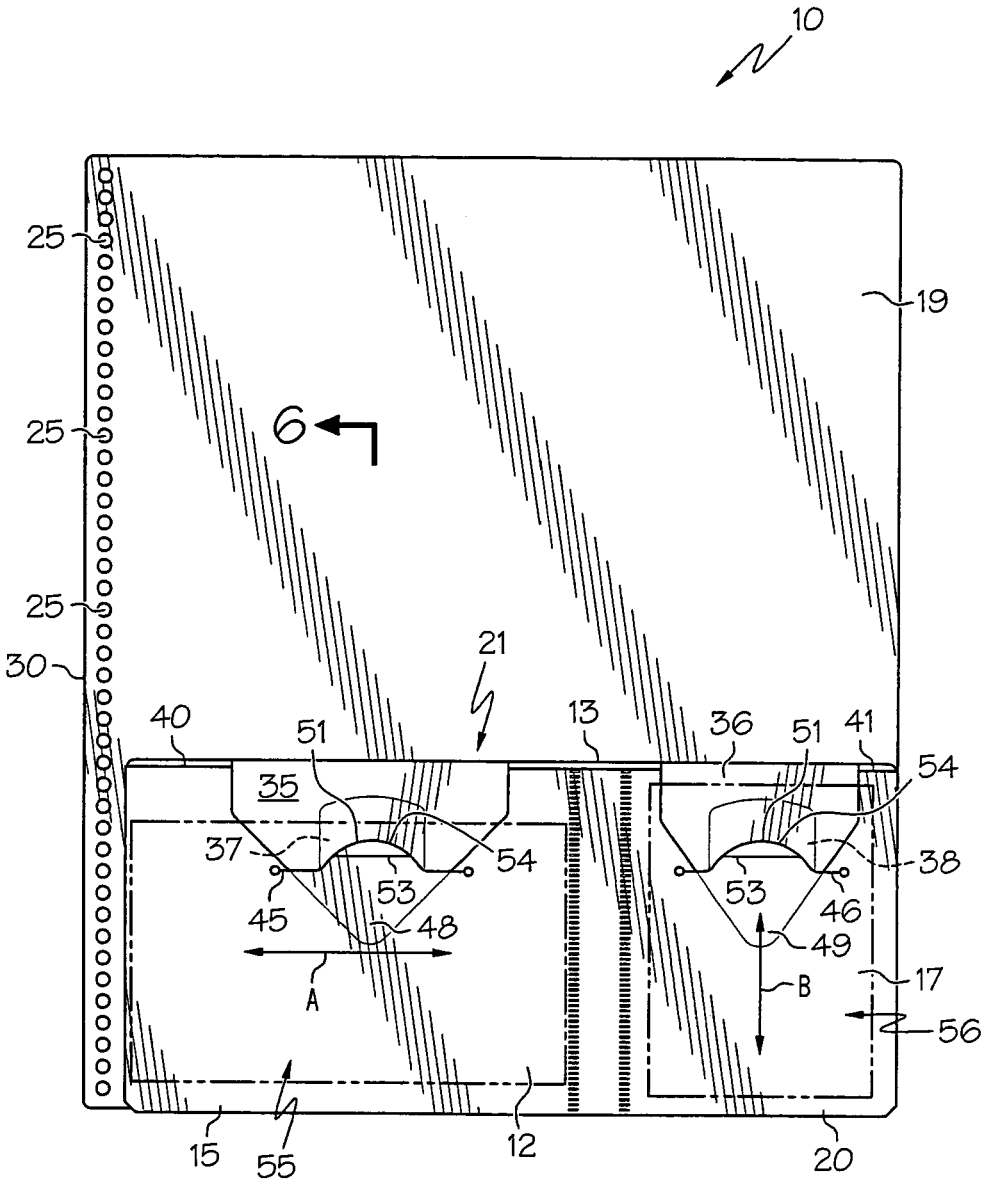
FIG. 1 is a top view of a storage sheet of the present invention with the flaps in the closed position.
Figure 2:
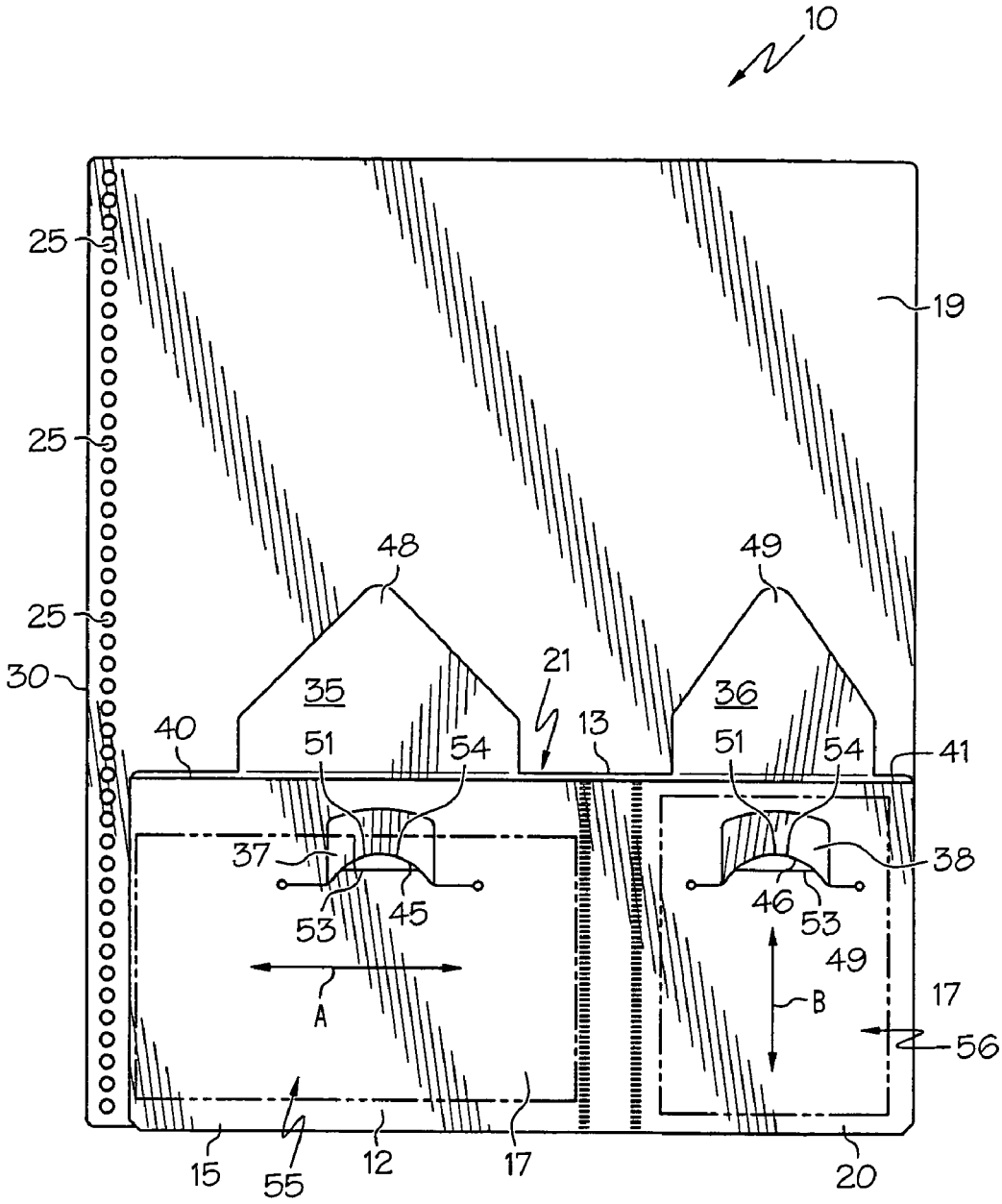
FIG. 2 is a top view of the storage sheet in FIG. 1 with the flaps in the open position.
Figure 4:
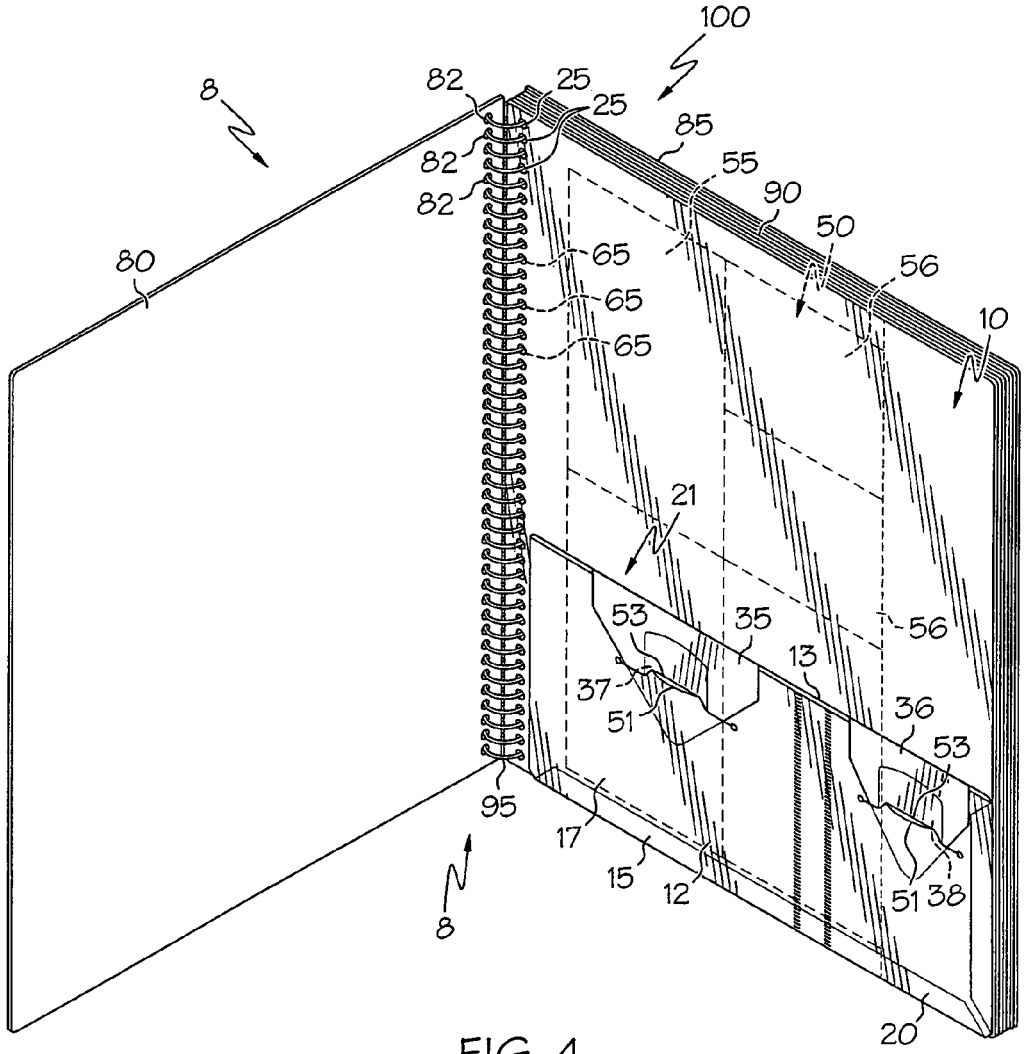
FIG. 4 is a front perspective view of the storage sheet of FIG. 1 and supply sheet of FIG. 3 bound in a notebook.
Figure 5:
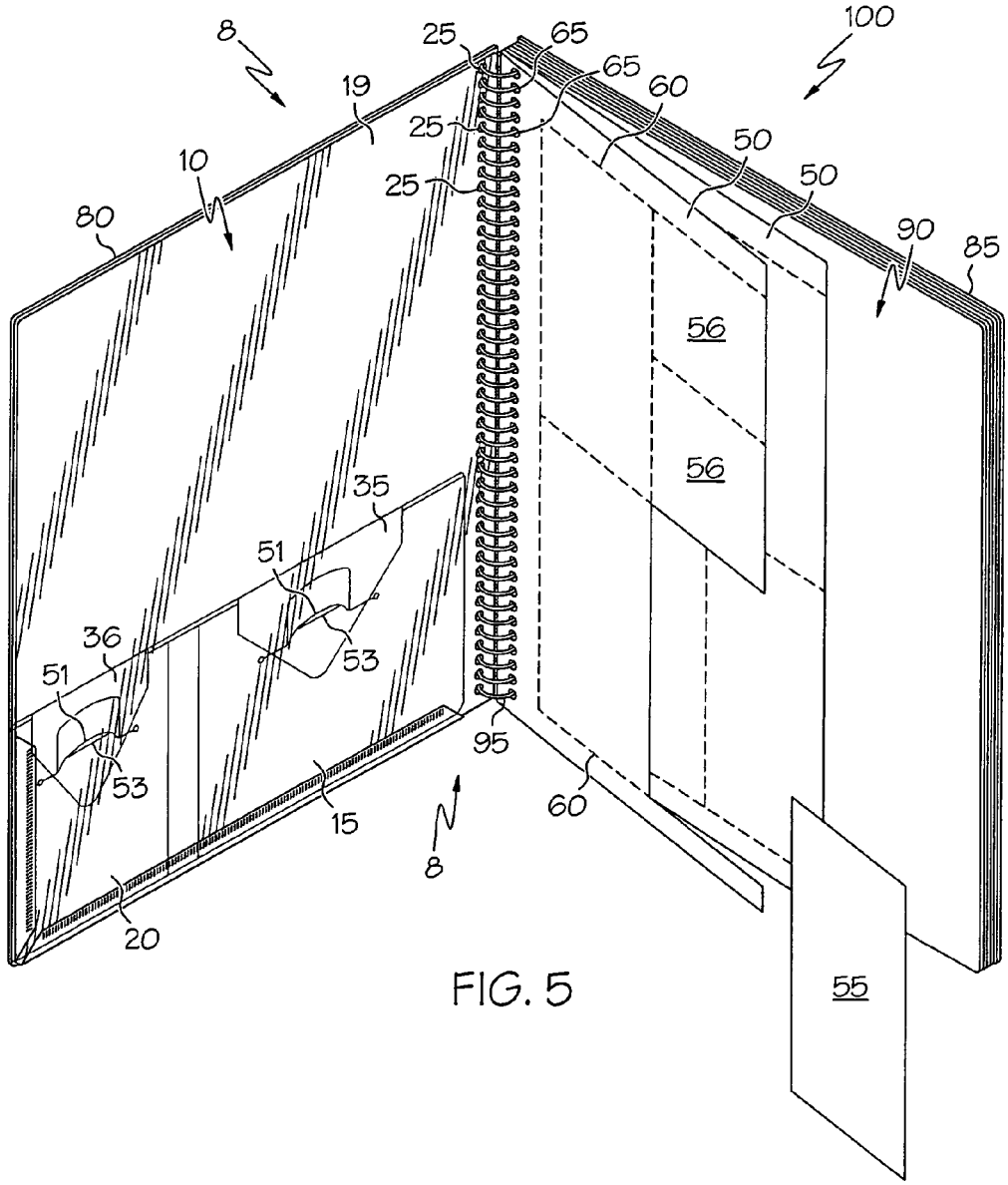
FIG. 5 is a front perspective view of the notebook of FIG. 4 with an index card detached from the supply sheet.

With reference to FIGS. 4 and 5, the system 8 of the present invention includes a storage sheet 10, a supply sheet 50, and a binding mechanism 95 binding the storage sheet 10 and supply sheet 50 together. As shown in FIGS. 1 and 2, the storage sheet 10 is generally rectangular in shape and may be made of a transparent polymeric material. The storage sheet 10 includes a first pocket 15 and a second pocket 20 located along a bottom edge of the storage sheet 10. The storage sheet 10 includes a number of holes 25 positioned along an inner or binding edge 30 thereof.

Figure 6:
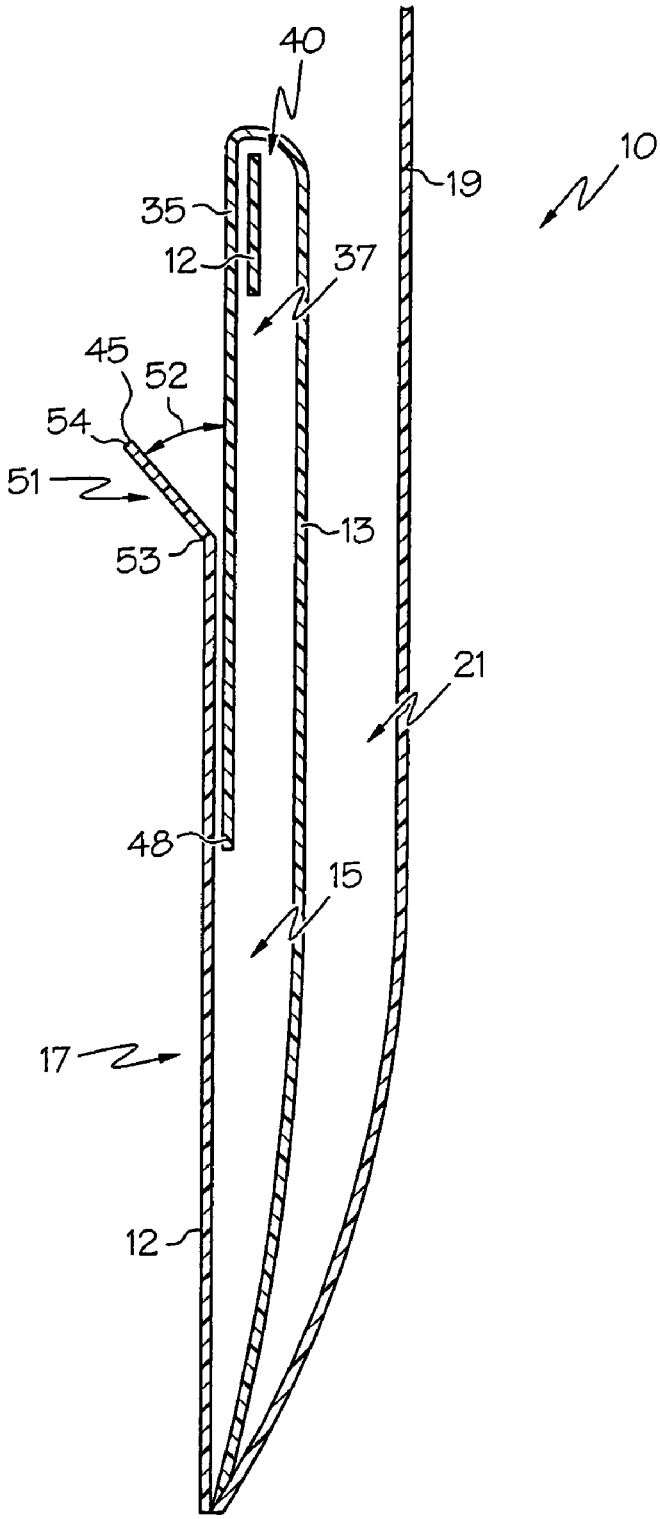
FIG. 6 is a partial side cross section of the storage sheet of FIG. 1, taken along line 6-6.

As shown in FIG. 6, storage sheet 10 includes a front piece of material 12 and a back piece of material 13 which define the pockets 15, 20 therebetween. The front piece of material 12 and back piece of material 13 together define a front flap 17. The front flap 17 faces and is generally parallel with a piece of backing material 19. The front flap 17 and piece of backing material 19 are joined at their bottom edges and define a panel pocket 21 therebetween.

Returning to FIG. 1, pocket 15 is generally rectangular in shape and has a longitudinal axis A oriented generally perpendicular to the binding edge 30. Pocket 20 is also generally rectangular in shape and has a longitudinal axis B oriented generally perpendicular to the longitudinal axis A of pocket 15 and parallel with the binding edge 30.

Each pocket 15, 20 includes a mouth 40, 41 located between the front 12 and back 13 pieces of material. Each pocket 15, 20 further includes a flap 35, 36, with each flap 35, 36 having a distal end 48, 49. Each pocket 15, 20 has a generally rectangular cut-out 37, 38 (FIG. 2) formed in the front panel 12 of each pocket 15, 20. A lower edge of each cut-out 37, 38 is or defines a slit or slit edge 45, 46. Each slit edge 45, 46 extends laterally beyond the associated cut-out 37, 38 as a slit or cut in the front panel 12 of the associated pocket 15, 20. The storage sheet 10, including the front piece of material 12, back piece of material 13, and flaps 35, 36 may be made of a generally transparent material, and the attached figures illustrate the storage sheet 10 as being generally transparent.

Each slit 45, 46 is shaped and located to receive the distal end 48, 49 of a flap 35, 36 thereunder to retain each flap 35, 36 in a closed position wherein each flap 35, 36 covers the associated mouth 40, 41. For example, FIG. 1 illustrates the flaps 35, 36 in their closed position wherein each flap 35, 36 generally cover the associated mouths 40, 41, and FIG. 2 illustrates the flaps 35, 36 in the open position wherein the flaps 35, 36 generally do not cover the associated mouths 40, 41. The pockets 15, 20 may be maintained with the flaps 35, 36 in the closed position by passing the distal ends 48, 49 of the flaps 35, 36 through the openings 37, 38 and through or under the slits 45, 46 such that the distal ends 48, 49 are received inside the pockets 15, 20.

The slits 45, 46 of the pockets 15, 16 define a lip 51 having a crease 53 and a tip 54. The tip 54 of the lip 51 is pivotable about at the crease 53, The tip 54 may be bent outwardly about the crease 53 such that the tip 54 or edge of the lip 51 forms an angle 52 (see FIG. 6) with the plane or main body of the pockets 15, 20. The outwardly-bent nature of the lip 51 helps to guide the distal ends 48, 49 of the flaps under the slit edges 45, 46 to thereby allow the flaps 35, 36 to easily be inserted under the slit edges 45, 46.

Figure 3:
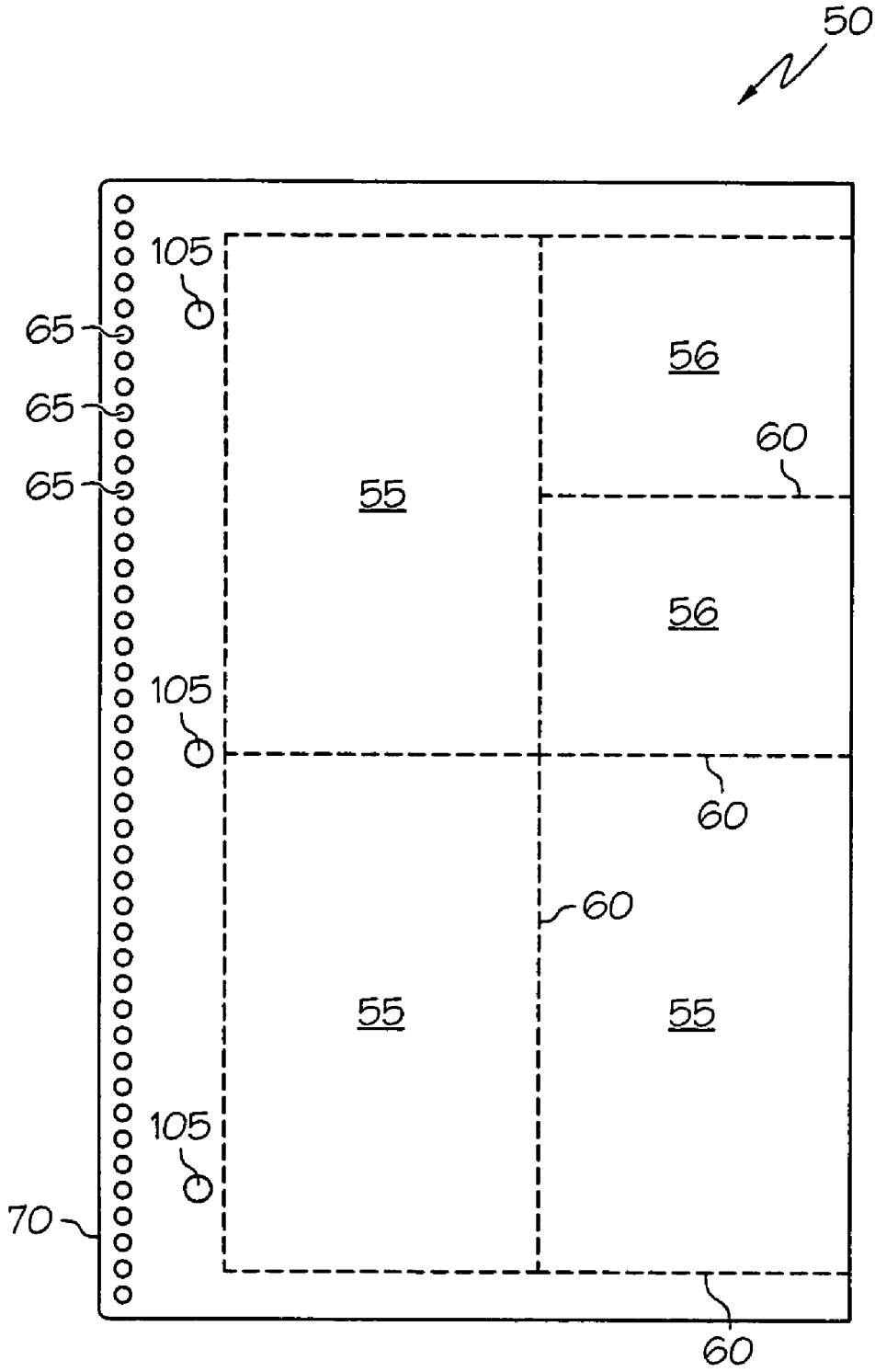
FIG. 3 is a top view of a supply sheet of the present invention.

FIG. 3 illustrates a supply sheet 50 having an inner or binding edge 70. The supply sheet 50 includes a number of holes 65 positioned along the binding edge 70 of the supply sheet 50. The supply sheet 50 includes a set of tear guide lines or perforations 60 which define a set of index cards 55, 56. In the illustrated embodiment, the perforations 60 define three full-sized index card 55 and two half-size index cards 56. The index cards 55, 56 are detachable from the supply sheet 50 by separating the individual index cards 55, 56 at the perforations 60. The perforations 60 define each of the individual index cards 55, 56 in the supply sheet 50. The supply sheet 50 and the individual index cards 55, 56 may be comprised of a generally cellulose based material such as paper or cardboard. Further, the individual full size index cards 55 are generally rectangular in shape and may have a dimension of about 3 inches by about 5 inches, or about 4 inches by about 6 inches, or various other sizes. The half-size index cards 56 also may be generally rectangular in shape and may have a dimension of about 1.5 inches by about 2.5 inches, or about 2 inches by about 3 inches, or various other sizes.

With reference to FIG. 5, an individual index card 55 may be detached from the supply sheet 50 by tearing along the perforations 60 in the supply sheet 50. The index card 55 may then be placed in pocket 15 as shown in FIG. 1. The index card 55 may be secured in the pocket 15 by covering the mouth 40 of pocket 15 by flap 35 such that distal end 48 of flap 35 is received within the slit 45.

Returning to FIGS. 1 and 2, pocket 15 may have dimensions roughly similar to the dimensions of a full size index card 55 and pocket 20 may have dimensions roughly similar to the dimensions of a half-size index card 56 such that each of the pocket 15, 20 can closely receive a full size 55 and half-size 56 index card therein, respectively. When a full size index card 55 is closely received in pocket 15 the longitudinal axis of the index card 55 is aligned with the longitudinal axis A of pocket 15. Also illustrated in FIGS. 1 and 2 is a half-size index card 56 closely received in pocket 20 such that the longitudinal axis of the half size index card 56 is aligned with the longitudinal axis B of pocket 20. If desired, a full size index card 55 may be stored in a vertical configuration in pocket 20. When a transparent material is used to construct the pockets 15, 20 and storage sheet 10, the top-most index card in the pockets 15, 20 is visible and when the pockets 15, 20 are empty such empty status can be easily identified.

Referring to FIG. 4, storage sheet 10 may be bound to the supply sheet 50 by a binding mechanism 95 to form a notebook 100. Several supply sheets 50 and/or several storage sheets 10 may be used in the same notebook 100 depending on the requirements of the user. The notebook 100 may include a front cover 80, a back cover 85 and a plurality of sheets of paper 90, each having a number of holes 82 positioned along a binding edge thereof. Each of the covers 80, 85 may be made of cardboard or polymer material, and may have a thickness and/or stiffness greater than the sheets of paper 90. In the illustrated embodiment, the binding mechanism 95 may be a helical coil. The storage sheet 10, supply sheet 50 and plurality of sheets of paper 90 may be positioned between the front cover 80 and back cover 85 so that the holes 25, 65, 82 are aligned and receive a turn of helical coil 95 therethrough to bind the storage sheets 10, supply sheet 50, plurality of sheets of paper 90, front cover 80 and back cover 85 together to form a notebook 100.

Alternatively, other binding mechanisms may be used in place of a helical coil 95. For example, the front cover 80, back cover 85, plurality of sheets of paper 90, storage sheet 10, and supply sheet 50 may be bound together using a glue or adhesive binding, brackets, a stitched binding, a twin-wire binding, or any other binding mechanism.

In the illustrated embodiment, the supply sheet 50 has generally the same shape as the storage sheet 10 and the sheets of paper 90, but has is somewhat smaller and therefore has a smaller size. The backing material 19 is also illustrated as having generally the same size and shape as the sheets of paper 90 and covers 80, 85. However, the supply sheet 50 and/or storage sheet 10 may also be of various other sizes and shapes, and in one embodiment are generally the same size and shape as the plurality of sheets of paper 90.

The system 8 of the present invention enables index cards 55 to be easily stored in the index card storage sheet 50 and detached when necessary. Binding the storage sheet 10 and supply sheet 50 together with the front cover 80, back cover 85 and plurality of sheets of paper 90 to form a notebook 100 minimizes the risk that index card 55 will be misplaced. Once the index cards 55 have been detached from index card storage sheet 50, they may be placed in the pockets 15, 20 of the storage sheet 10 so that they are not lost.

The storage sheet 10 and supply sheet 50 may each include three binding holes 105 positioned along the respective binding edges 30, 70, as shown in FIG. 3. The three binding holes 105 allow a user to place the storage sheet 10 and supply sheet 50 into a three-ring binder, such that the three-ring binder acts as a binding mechanism.

Although the invention is shown and described with respect to certain embodiments, it is obvious that equivalents and modifications will occur to those skilled in the art upon reading and understanding the specification. The present invention includes all such equivalents and modifications and is limited only by the scope of the claims.

What is claimed is:

1. A storage system comprising:

at least one storage sheet, said at least one storage sheet having at least one card pocket positioned thereon and sized to receive an index card therein; said card pocket generally formed in a plane and comprising a front and a back piece of material joined at least along their bottom edge;

said at least one storage sheet comprising a backing sheet joined to said card pocket at least along said bottom edge;

a panel pocket between said card pocket and said backing sheet;

wherein said card pocket includes a mouth and a flap for selectively covering said mouth in a closed position;

wherein said card pocket includes a cut-out in a front panel thereof, along a lower edge of said cut-out being a slit edge for receiving at least part of said flap thereunder to retain said flap in a closed position wherein said flap generally covers said mouth, wherein said slit edge extends laterally beyond said cut-out; wherein said slit edge defines an outwardly bent lip having a crease and a tip, the tip pivotable about the crease, the tip bent outwardly about the crease such that the tip of the outwardly bent lip forms an angle with the plane to guide the flap under the slit edge when said flap is moved to said closed position.

2. The system of claim 1 further comprising a binding mechanism, wherein said at least one storage sheet includes a binding edge to be received by said binding mechanism.

3. The system of claim 2 further comprising a plurality of sheets of paper, each of said plurality of sheets of paper being bound to said at least one storage sheet by said binding mechanism.

4. The system of claim 3 further comprising a front cover and a back cover, said front cover and said back cover being bound to said at least one storage sheet and said plurality of sheets of paper by said binding mechanism.

5. The system of claim 2 wherein said binding mechanism is a helical or twin wire coil.

6. The system of claim 1 wherein said at least one storage sheet includes two of said card pockets, a first of said card pockets being generally rectangular in shape and having a longitudinal axis and a second of said card pockets being generally rectangular in shape and having a longitudinal axis that is perpendicular to said axis of said first of said card pockets.

7. The system of claim 1 wherein said at least one storage sheet includes two of said card pockets, said card pockets being sized to store differently-sized index cards therein.

8. The system of claim 1 wherein said card pocket is generally rectangular in shape and has dimensions of about 3 inches by about 5 inches.

9. The system of claim 7 wherein one of said card pockets is smaller than another of said card pockets.

10. The system of claim 1 wherein said card pocket is sized to receive a half-sized index card.

11. The system of claim 1 wherein said card pocket is generally entirely made of a generally transparent material such that said index card received therein is generally visible therethrough.

12. The system of claim 1 wherein said card pocket is configured to entirely and closely receive an index card therein.

13. The system of claim 12 wherein said card pocket is generally transparent such that when said index card is received therein at least one side of said index card is generally visible through said card pocket.

14. The system of claim 7 wherein said card pockets are spaced apart and arranged in a generally co-planar, non-overlapping configuration.

15. The system of claim 1 wherein said index card has a front surface and a back surface, wherein when said index card is placed in said card pocket, at least one of said front and back surfaces is entirely visible.

* * * * *